US010526933B2

(12) United States Patent
Morii et al.

(10) Patent No.: US 10,526,933 B2
(45) Date of Patent: Jan. 7, 2020

(54) HOLLOW ENGINE VALVE AND MANUFACTURING METHOD THEREFOR

(71) Applicant: FUJI HOLLOW VALVE INC., Kikugawa-shi, Shizuoka (JP)

(72) Inventors: Hirokazu Morii, Tokyo (JP); Hidenobu Nishio, Tokyo (JP); Kenichiro Hirao, Tokyo (JP)

(73) Assignee: FUJI HOLLOW VALVE INC., Kikugawa-Shi (JP)

( * ) Notice: Subject to any disclaimer, the term of this patent is extended or adjusted under 35 U.S.C. 154(b) by 50 days.

(21) Appl. No.: 15/503,601

(22) PCT Filed: Jul. 24, 2015

(86) PCT No.: PCT/JP2015/071070

§ 371 (c)(1),
(2) Date: Feb. 13, 2017

(87) PCT Pub. No.: WO2016/031455

PCT Pub. Date: Mar. 3, 2016

(65) Prior Publication Data

US 2017/0234175 A1 Aug. 17, 2017

(30) Foreign Application Priority Data

Aug. 27, 2014 (JP) ..... 2014-172638

(51) Int. Cl.
*B21K 1/22* (2006.01)
*F01L 3/20* (2006.01)
(Continued)

(52) U.S. Cl.
CPC *F01L 3/20* (2013.01); *B21K 1/22* (2013.01); *F01L 3/14* (2013.01); *F01L 3/24* (2013.01); *F01L 2103/00* (2013.01)

(58) Field of Classification Search
CPC ..... F01L 3/20; F01L 3/14; F01L 3/24; F01L 2103/00; B21K 1/22
See application file for complete search history.

(56) References Cited

U.S. PATENT DOCUMENTS 8,522,434 B2 9/2013 Yoshimura
9,427,795 B2 * 8/2016 Morii ..... F01L 3/14
(Continued)

FOREIGN PATENT DOCUMENTS

CN 10215799 A 8/2011
JP 56-147305 U 11/1981
(Continued)

OTHER PUBLICATIONS

Chinese Office Action dated Sep. 30, 2018 issued in corresponding Chinese Application No. 201580046096.8.

*Primary Examiner* — Ryan J. Walters
(74) *Attorney, Agent, or Firm* — Birch, Stewart, Kolasch & Birch, LLP

(57) ABSTRACT

The present invention provides a hollow engine valve achieving high durability while suppressing an increase in manufacturing cost, and a manufacturing method therefor. A manufacturing method for a hollow engine valve comprises: a step of forming, by forging, a solid round bar as a material of a valve main body into a valve main body intermediate member provided with a semifinished product valve head portion corresponding to a valve head portion and a solid stem portion corresponding to a valve stem portion; a step of performing cutting process with respect to the valve main body intermediate member across the solid stem portion and the semifinished product valve head portion for forming a semifinished product hollow hole with a bottom corresponding to a hollow hole, thereby forming the valve main body intermediate member into a valve main body semifinished product provided with the semifinished product valve head
(Continued)

portion and a semifinished product valve stem portion; and a step of performing necking process with respect to the valve main body semifinished product for squeezing the semifinished product valve stem portion step by step, thereby reducing the diameter of the semifinished product valve stem portion and increasing the length of the stem of the semifinished product valve stem portion, to form the valve main body semifinished product into the valve main body.

3 Claims, 4 Drawing Sheets

(51) Int. Cl.
*F01L 3/24* (2006.01)
*F01L 3/14* (2006.01)

(56) References Cited

U.S. PATENT DOCUMENTS

| | | | | |
|---|---|---|---|---|
| 2011/0174259 | A1 | 7/2011 | Yoshimura | |
| 2013/0313463 | A1 | 11/2013 | Yoshimura | |
| 2014/0033532 | A1 | 2/2014 | Yoshimura | |
| 2014/0366373 | A1* | 12/2014 | Morii | F01L 3/14<br>29/888.451 |

FOREIGN PATENT DOCUMENTS

| | | | | |
|---|---|---|---|---|
| JP | 4-47106 | A | 2/1992 | |
| JP | 4-334708 | A | 11/1992 | |
| JP | 2010-94732 | A | 4/2010 | |
| JP | 2013-155676 | A | 8/2013 | |
| WO | WO 2010/032799 | A1 | 3/2010 | |
| WO | WO 2011/104903 | A1 | 9/2011 | |
| WO | WO 2012/168136 | A1 | 12/2012 | |
| WO | WO 2013/114989 | A1 | 8/2013 | |
| WO | WO-2013114989 | A1 * | 8/2013 | F01L 3/14 |

* cited by examiner

HOLLOW ENGINE VALVE AND MANUFACTURING METHOD THEREFOR

TECHNICAL FIELD

The present invention relates to a hollow engine valve and a manufacturing method therefor, particularly to a hollow engine valve including a valve main body in which a hollow hole with a bottom is formed through both a valve head portion and a valve stem portion connected to the valve head portion, and a manufacturing method therefor.

BACKGROUND ART

As output and performance of engines have increased in recent years, demands have increased for engine valves allowing valve opening and closing operations with high accuracy. In this respect, there have been provided hollow engine valves which are formed to have a hollow inside to achieve weight reduction. A manufacturing method for such a hollow engine valve is disclosed in Patent Document 1.

PRIOR ART DOCUMENT

Patent Document

Patent Document 1:Japanese Patent Application Publication No. 2010-094732

SUMMARY OF THE INVENTION

Problems to Be Solved by the Invention

In a conventional manufacturing method for hollow engine valves, as disclosed in Patent Document 1, a solid round bar which is a material of a hollow engine valve is formed, by forging, into an intermediate member having an enlarged diameter portion to be a valve head portion, and a solid trunk portion. Then, a hollow hole with a bottom is formed by a punching process on the upper surface of the intermediate member, thereby obtaining a semifinished product of the hollow engine valve. After that, the enlarged diameter portion and the trunk portion of the semifinished product are drawn, by forging, to form a finished product of the hollow engine valve.

Meanwhile, in the case where the hollow engine valve is used for an exhaust valve, the hollow engine valve has to be manufactured from heat-resistant steel or heat-resistant alloy having high heat resistance to be capable of enduring the use environment of being exposed to high temperature exhaust. However, materials having such a high heat-resistance are generally difficult-to-cut materials, and often shorten tool lives.

In particular, as described in Patent Document 1, in the case where the hollow hole with a bottom is formed by a punching process on the upper surface of the intermediate member made of a difficult-to-cut material, in the step of obtaining the semifinished product of the hollow engine valve, there is a problem that the manufacturing cost increases because a tool (punch) used for the punching process has to be changed only after several times of use.

Meanwhile, it may be a possible solution to form a solid semifinished product having the same outer shape as that of a finished product of the hollow engine valve, and then form the hollow hole in the stem portion of the semifinished product by a cutting process. However, in this case, a narrow, long hole having an extremely large ratio of the diameter to the length has to be made by drilling, which makes the process itself difficult and the tool life very short.

In addition, in the conventional manufacturing method as described in Patent Literature 1, the bottom surface of the hollow hole in the semifinished product of the hollow engine valve is flat, and the angle formed by the bottom surface and the inner circumference surface of the hollow hole is about 90°. In this case, if the enlarged diameter portion and the trunk portion of the semifinished product are drawn by forging, the corner of the bottom surface and the inner circumference surface of the hollow hole is folded, and the radius of the corner becomes small. As a result, during the use of the hollow engine valve, stress concentration tends to occur at this corner, and may decrease the durability of the hollow engine valve.

The present invention has been made to solve the problems of the conventional art described above, and an object thereof is to provide a hollow engine valve with high durability and a manufacturing method therefor, while suppressing an increase in the manufacturing cost.

Means for Solving the Problems

To attain the above object, a manufacturing method for a hollow engine valve according to the present invention is a manufacturing method for a hollow engine valve including a valve main body in which a hollow hole with a bottom is formed through both a valve head portion and a valve stem portion connected to the valve head portion, characterized in that the manufacturing method comprises the steps of: forming, by forging, a solid round bar which is a material of the valve main body into a valve main body intermediate member having a semifinished product valve head portion to be the valve head portion and a solid stem portion to be the valve stem portion; forming the valve main body intermediate member into a valve main body semifinished product having the semifinished product valve head portion and a semifinished product valve stem portion to be the valve stem portion, by performing a cutting process on the valve main body intermediate member through both the solid stem portion and the semifinished product valve head portion to form a semifinished product hollow hole with a bottom, the semifinished product hollow hole being to be the hollow hole; and forming the valve main body semifinished product into the valve main body, by performing a necking process on the valve main body semifinished product by drawing the semifinished product valve stem portion in stages to reduce a diameter of the semifinished product valve stem portion and increase a shaft length of the semifinished product valve stem portion.

In the present invention thus configured, since after forming, by forging, a solid round bar which is a material of a valve main body into a valve main body intermediate member having a semifinished product valve head portion and a solid stem portion, the valve main body intermediate member is formed into a valve main body semifinished product having the semifinished product valve head portion and a semifinished product valve stem portion, by performing a cutting process on the valve main body intermediate member through both the solid stem portion and the semifinished product valve head portion to form a semifinished product hollow hole with a bottom, even in the case where a difficult-to-cut material is used as a material of the hollow engine valve, the semifinished product hollow hole can be formed using a cutting tool (a drill bit) suitable for processing the difficult-to-cut material. This reduces cost necessary for tools and shortens a process cycle time, compared to the case where the semifinished product hollow hole is formed by a punching process in the valve main body intermediate member and the case where the narrow, long hollow hole is formed by a cutting process in the stem portion of the solid semifinished product having the same outer shape as that of the finished product of the hollow engine valve. Accordingly, it is possible to suppress an increase in the manufacturing cost of the hollow engine valve.

In the present invention, in the step of forming the semifinished product hollow hole to be the hollow hole, the semifinished product hollow hole is formed preferably with a drill bit with an inclined tip end.

In the present invention thus configured, the bottom surface of the semifinished product hollow hole can be formed in an inverted cone shape. This suppresses reduction of the radius of the corner caused by the corner of the bottom surface and the inner circumference surface of the hollow hole being folded when the necking process is performed on the semifinished product valve stem portion, compared to the case where the bottom surface of the semifinished product hollow hole is flat. Accordingly, it is possible to reduce the stress concentration generated at the corner during the use of the hollow engine valve and manufacture the hollow engine valve with high durability.

In addition, in the present invention, an angle of the tip end of the drill bit is preferably from 140° to 178° inclusive.

In the present invention thus configured, the bottom surface of the semifinished product hollow hole can be formed in an inverted cone shape with an apex angle of from 140° to 178° inclusive. This makes it possible to suppress the reduction of the radius of the corner between the bottom surface and the inner circumference surface of the hollow hole when the necking process is performed on the semifinished product valve stem portion, while keeping the inner diameter of the bottom surface of the hollow hole an appropriate size. Accordingly, it is possible to manufacture the hollow engine valve in which weight reduction and high cooling performance achieved by forming the hollow hole with an appropriate size is made compatible with high durability achieved by the reduction of stress concentration at the corner of the bottom surface and the inner circumference surface of the hollow hole.

Moreover, the hollow engine valve of the present invention is characterized in that the hollow engine valve comprises a valve main body in which a hollow hole with a bottom is formed through both a valve head portion and a valve stem portion connected to the valve head portion, a bottom surface of the valve head portion is flat or concave, and a bottom surface of the hollow hole is concave.

In the present invention thus configured, it is possible to suppress the reduction of the radius of the corner caused by the corner of the bottom surface and the inner circumference surface of the hollow hole being folded when manufacturing the hollow engine valve, compared to the case where the bottom surface of the hollow hole is flat. Accordingly, it is possible to reduce the stress concentration generated at the corner during the use of the hollow engine valve and obtain the hollow engine valve with high durability.

In the present invention, the bottom surface of the hollow hole is preferably formed in an inverted cone shape.

In the present invention thus configured, it is possible to suppress the reduction of the radius of the corner caused by the corner of the bottom surface and the inner circumference surface of the hollow hole being folded when manufacturing the hollow engine valve, compared to the case where the bottom surface of the hollow hole is flat. Accordingly, it is possible to reduce the stress concentration generated at the corner during the use of the hollow engine valve and obtain the hollow engine valve with high durability.

In addition, in the present invention, the bottom surface of the hollow hole is formed in the inverted cone shape preferably with an apex angle of from 140° to 178° inclusive.

In the present invention thus configured, it is possible to suppress the reduction of the radius of the corner caused by the corner of the bottom surface and the inner circumference surface of the hollow hole being folded when manufacturing the hollow engine valve, while keeping the inner diameter of the bottom surface of the hollow hole an appropriate size. Accordingly, this makes it possible to obtain the hollow engine valve in which weight reduction and high cooling performance achieved by the hollow hole with an appropriate size being formed is made compatible with high durability achieved by the reduction of stress concentration generated at the corner of the bottom surface and the inner circumference surface of the hollow hole during the use of the hollow engine valve.

EFFECT OF THE INVENTION

The hollow engine valve and the manufacturing method therefor according to the present invention make it possible to obtain the hollow engine valve with high durability, while suppressing an increase in the manufacturing cost.

MODE FOR CARRYING OUT THE INVENTION

Hereinafter, referring to the accompanying drawings, descriptions will be provided for a hollow engine valve and a manufacturing method therefor according to an embodiment of the present invention.

Figure 1:
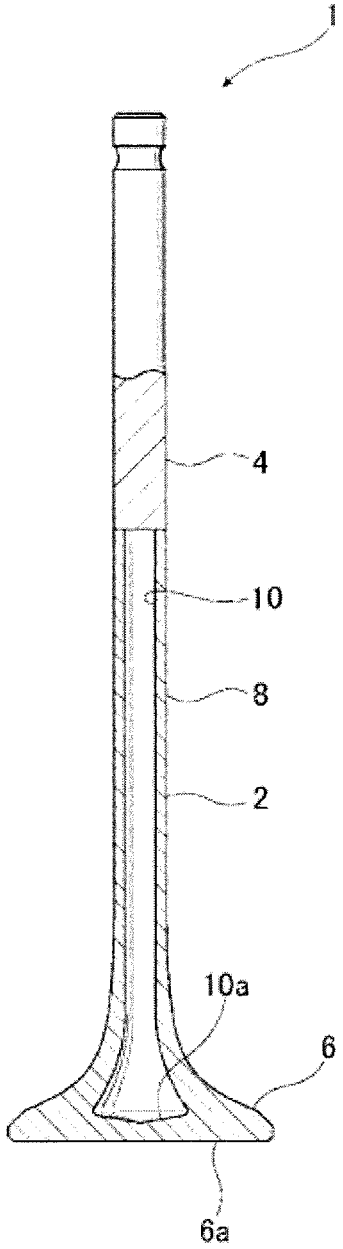
FIG. 1 is a cross-sectional view of a finished product of a hollow engine valve according to an embodiment of the present invention.

First, using FIG. 1, the hollow engine valve according to the embodiment of the present invention will be described. FIG. 1 is a cross sectional view of a finished product of the hollow engine valve of the embodiment of the present invention.

First, the reference numeral 1 in FIG. 1 indicates the hollow engine valve according to the embodiment of the present invention. The hollow engine valve 1 is used as an intake valve or an exhaust valve in an internal-combustion engine for a vehicle or the like.

The hollow engine valve 1 includes a valve main body 2 which is hollow and a stem end closing member 4 which is solid.

The valve main body 2 includes a valve head portion 6 in an umbrella shape and a valve stem portion 8 extending axially from the valve head portion 6. For example, the outer diameter of a bottom surface 6*a* of the valve head portion 6 is 30 mm, and the outer diameter of the valve stem portion 8 is 6 mm. Passing through both the valve head portion 6 and the valve stem portion 8, a hollow hole 10 with a bottom is formed along the outer shape of the valve head portion 6 and the valve stem portion 8. The inner diameter of a bottom surface 10*a* of the hollow hole 10 is larger than the inner diameter at the valve stem portion 8. For example, the inner diameter of the bottom surface 10*a* of the hollow hole 10 is 10 mm, and the inner diameter of the hollow hole 10 at the valve stem portion 8 is 3 mm. The inside of the hollow hole 10 may be filled with metallic sodium for coolant, for example. In the descriptions hereafter, the direction extending from the valve stem portion 8 toward the valve head portion 6 along the axis of the hollow engine valve 1 is defined as the downward direction, and the direction extending from the valve head portion 6 toward the valve stem portion 8 is defined as the upward direction.

The stem end closing member 4 has the same outer diameter as that of the valve stem portion 8 of the valve main body 2, and the upper end of this valve stem portion 8 and the lower end of the stem end closing member 4 are joined to each other.

As illustrated in FIG. 1, the bottom surface 6*a* of the valve head portion 6 of the valve main body 2 is flat while the bottom surface 10*a* of the hollow hole 10 at the valve head portion 6 is concave. More specifically, the bottom surface 10*a* of the hollow hole 10 is formed in an inverted cone shape, and is formed such that the apex angle is within a range from 140° to 178° inclusive.

As a material for the valve main body 2 and the stem end closing member 4, a heat-resistant material which is a high-tensile steel equivalent to HT80 and which has a tensile strength of 300 MPa or higher at 800° C. (for example, heat-resistant steel in SUH series, heat-resistant alloy in NCF series, or the like) is used.

Figure 2:
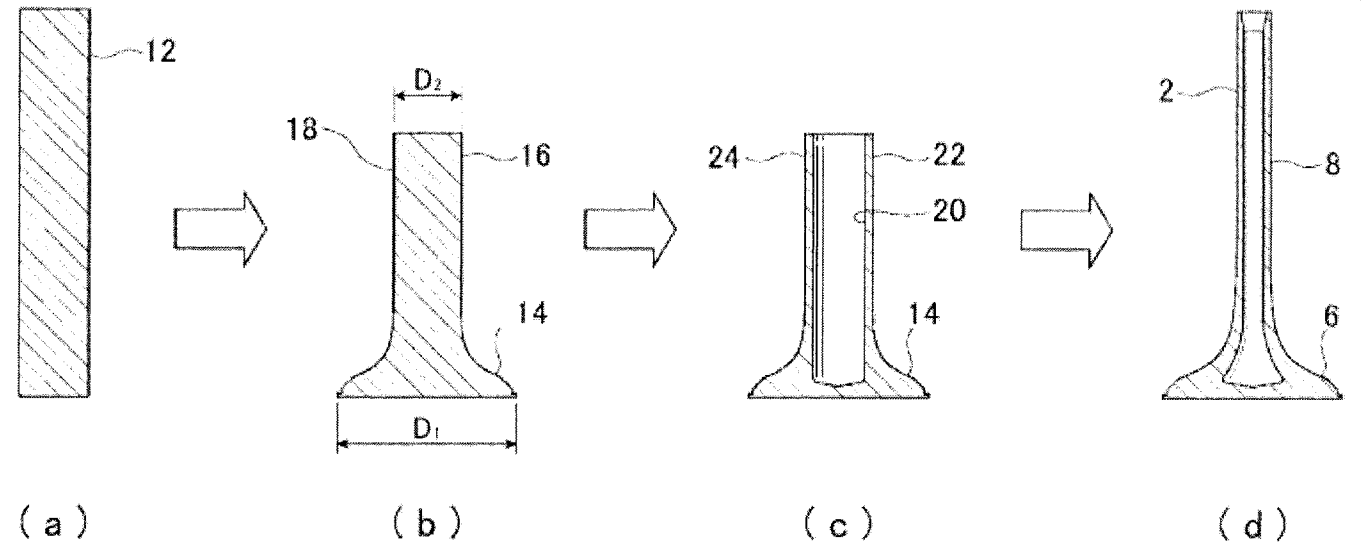
FIG. 2 is a process drawing indicating manufacturing steps of the hollow engine valve according to the embodiment of the present invention.
Figure 3A:
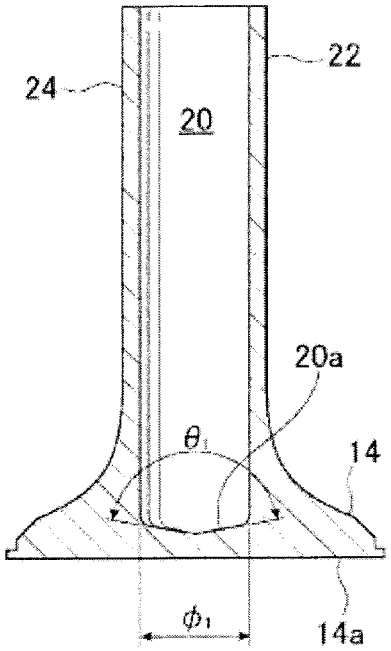
FIG. 3A is a cross-sectional view of a valve main body semifinished product of the hollow engine valve according to the embodiment of the present invention.
Figure 3B:
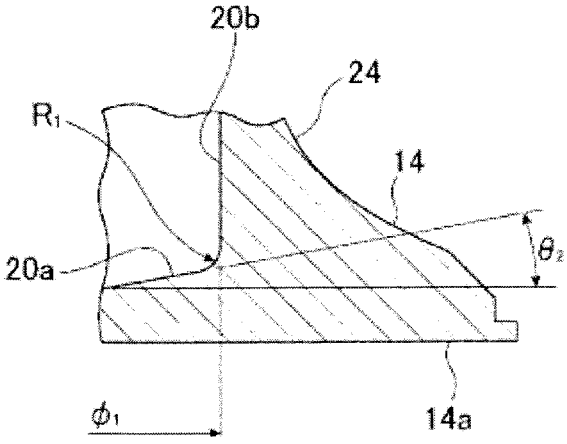
FIG. 3B is an enlarged cross-sectional view of a semifinished product valve head portion of the valve main body semifinished product of the hollow engine valve according to the embodiment of the present invention.
Figure 4A:
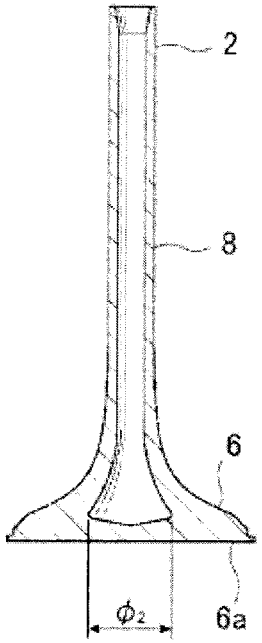
FIG. 4A is a cross-sectional view of a valve main body of the hollow engine valve according to the embodiment of the present invention.
Figure 4B:
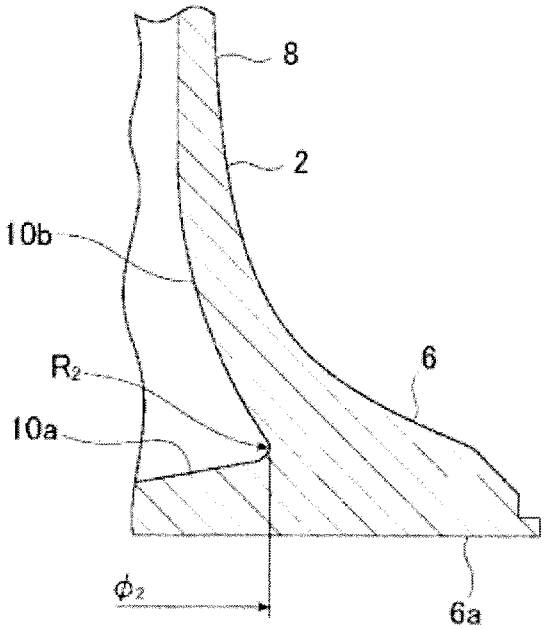
FIG. 4B is an enlarged cross-sectional view of a valve head portion of the valve main body of the hollow engine valve according to the embodiment of the present invention.

Next, using FIGS. 2 to 4, descriptions are provided for a manufacturing method for the hollow engine valve 1 according to the embodiment of the present invention. FIG. 2 is a process drawing indicating manufacturing steps of the hollow engine valve 1 according to the embodiment of the present invention. In addition, FIG. 3A is a cross-sectional view of a valve main body semifinished product 24 of the hollow engine valve 1 according to the embodiment of the present invention, and FIG. 3B is an enlarged cross sectional view of a semifinished product valve head portion 14 of the valve main body semifinished product 24. In addition, FIG. 4A is a cross-sectional view of the valve main body 2 of the hollow engine valve 1 according to the embodiment of the present invention, and FIG. 4B is an enlarged cross-sectional view of the valve head portion 6 of the valve main body 2.

First, as indicated at (a) in FIG. 2, a solid round bar 12 is prepared which has been processed to have a predetermined length and a predetermined outer diameter.

Next, as indicated at (b) in FIG. 2, a valve main body intermediate member 18 having the semifinished product valve head portion 14 to be the valve head portion 6 and a solid stem portion 16 to be the valve stem portion 8 is formed by performing one or more forging processes for the solid round bar 12. The outer diameter $D_1$ of a bottom surface 14*a* of the semifinished product valve head portion 14 formed at this time is slightly larger than the outer diameter of the bottom surface 6*a* of the valve head portion 6 of the finished product, and is 32 mm, for example. Meanwhile, the outer diameter $D_2$ of the solid stem portion 16 is larger than the outer diameter of the valve stem portion 8 of the finished product, and is from 14 to 20 mm, for example. Note that any forging method of cold forging, warm forging, and hot forging may be used for the forging process in this step.

Then, as indicated at (c) in FIG. 2, a cutting process is performed on the valve main body intermediate member 18 through both the solid stem portion 16 and the semifinished product valve head portion 14 to form a semifinished product hollow hole 20 with a bottom to be the hollow hole 10. By doing this, the valve main body intermediate member 18 is formed into the valve main body semifinished product 24 having the semifinished product valve head portion 14 and a semifinished product valve stem portion 22 to be the valve stem portion 8.

As illustrated in FIG. 3A, in the cutting process to form this semifinished product hollow hole 20, the semifinished product hollow hole 20 with a bottom is formed passing through both the solid stem portion 16 and the semifinished product valve head portion 14. This cutting process is performed using a drilling unit equipped with a through-spindle coolant function. Specifically, the drilling unit is equipped with a carbide drill bit having a through coolant hole, and coolant is supplied to the drill bit at a pressure of 2 MPa or higher. This drilling unit makes a hole by a cutting process from the upper end of the solid stem portion 16 to the semifinished product valve head portion 14, holding the outer periphery of the semifinished product valve head portion 14. The inner diameter $\varphi_1$ of the semifinished product hollow hole 20 thus formed is slightly larger than the inner diameter of the bottom surface 10*a* of the hollow hole 10 of the finished product, and $\varphi_1$=10.7 mm, for example.

In addition, the angle of the tip end of the drill bit used for this cutting is from 140° to 178° inclusive. Accordingly, as illustrated in FIG. 3A, a bottom surface 20*a* of the semifinished product hollow hole 20 is formed in an inverted cone shape with an apex angle $\theta_1$ of from 140° to 178° inclusive. In other words, as illustrated in FIG. 3B, the bottom surface 20*a* of the semifinished product hollow hole 20 is formed such that the inclination angle $\theta_2$ is from 1° to 20° inclusive with respect to the bottom surface 14*a* of the semifinished product valve head portion 14. In addition, as illustrated in FIG. 3B, a specified roundness $R_1$ (for example, $R_1$=1.0 mm) is formed at the corner of the bottom surface 20*a* and an inner circumference surface 20*b* of the semifinished product hollow hole 20 formed in this cutting process.

In the case where the angle of the tip end of the drill bit is smaller than 140° (in other words, in the case where the inclination angle $\theta_2$ of the bottom surface 20*a* of the semifinished product hollow hole 20 is larger than 20°), assuming the material thickness of the bottom surface 14*a* of the semifinished product valve head portion 14 is constant, the volume of the semifinished product hollow hole 20 of this semifinished product valve head portion 14 is smaller. Accordingly, the advantageous effects of the weight reduction and the increase of the cooling performance obtained by forming the hollow hole 10 are decreased. On the other hand, in the case where the angle of the tip end of the drill bit is larger than 178° (in other words, in the case where the inclination angle $\theta_2$ of the bottom surface 20*a* of the semifinished product hollow hole 20 is smaller than 1°), when the semifinished product valve stem portion 22 is subjected to a necking process to be described later, the corner of the bottom surface 10*a* and an inner circumference surface 10*b* of the hollow hole 10 is folded, which makes the radius of the corner becomes small. As a result, when the hollow engine valve is used, the small radius of the corner makes it easy for stress concentration to occur at the corner, and the durability of the hollow engine valve 1 may decrease. Hence, as described above, it is desirable that the angle of the tip end of the drill bit be from 140° to 178° inclusive (in other words, the inclination angle $\theta_2$ of the bottom surface 20*a* of the semifinished product hollow hole 20 be from 1° to 20° inclusive).

After the cutting process described above to form the semifinished product hollow hole 20, as illustrated at (d) in FIG. 2, by performing multiple times (for example, 8 to 15 times) of a necking process (drawing process) on the valve main body semifinished product 24 by drawing the semifinished product valve stem portion 22 in stages, the diameter of the semifinished product valve stem portion 22 is reduced, and the shaft length of the semifinished product valve stem portion 22 is increased. With this process, the valve main body semifinished product 24 is formed into the valve main body 2 having the valve head portion 6 and the valve stem portion 8.

Through the necking process, the outer diameter of the semifinished product valve stem portion 22 is reduced to that of the valve stem portion 8 (for example, 6 mm), and the length of the semifinished product valve stem portion 22 along the axis is increased. Through this necking process, the lower end portion of the semifinished product valve stem portion 22 (the connecting portion to the semifinished product valve head portion 14) is drawn so as to incline to the center axis side. Along with this, as illustrated in FIG. 4B, $R_2$ at the corner of the bottom surface 10*a* and the inner circumference surface 10*b* of the hollow hole 10 becomes smaller than $R_1$ at the corner of the bottom surface 20*a* and the inner circumference surface 20*b* of the semifinished product hollow hole 20 illustrated in FIG. 3B (for example, $R_2$=0.2 mm). In addition, the inner diameter $\varphi_2$ of the bottom surface 10*a* of the hollow hole 10 becomes slightly smaller than the inner diameter $\varphi_1$ of the semifinished product hollow hole 20 (for example, $\varphi_2$=10 mm).

Then, by joining the stem end closing member 4 to the upper end of the valve stem portion 8 of the valve main body 2 and chamfering the outer periphery of the bottom surface 6*a* of the valve head portion 6, the hollow engine valve 1 is formed as a finished product.

Next, descriptions are provided for a further modification of the embodiment of the present invention.

In the embodiment described above, it is described that the bottom surface 6*a* of the valve head portion 6 of the valve main body 2 is flat. However, the bottom surface 6*a* of the valve head portion 6 may be concave.

Next, descriptions are provided for the operation and effect of an internal structure for a vehicle, according to the embodiment of the present invention and the modification of the embodiment of the present invention described above.

First, since after forming, by forging, a solid round bar 12 which is a material of a valve main body 2 into a valve main body intermediate member 18 having a semifinished product valve head portion 14 and a solid stem portion 16, the valve main body intermediate member 18 is formed into a valve main body semifinished product 24 having the semifinished product valve head portion 14 and a semifinished product valve stem portion 22, by performing a cutting process on the valve main body intermediate member 18 through both the solid stem portion 16 and the semifinished product valve head portion 14 to form a semifinished product hollow hole 20 with a bottom, even in the case where a difficult-to-cut material is used as a material of the hollow engine valve 1, the semifinished product hollow hole 20 can be formed using a cutting tool (a drill bit) suitable for processing the difficult-to-cut material. This reduces cost necessary for tools and shortens a process cycle time, compared to the case where the semifinished product hollow hole 20 is formed by a punching process in the valve main body intermediate member 18 and the case where the narrow, long hollow hole is formed by a cutting process in the stem portion of the solid semifinished product having the same outer shape as that of the finished product of the hollow engine valve 1. Accordingly, it is possible to suppress an increase in the manufacturing cost of the hollow engine valve 1.

In addition, since the drill bit with the inclined tip end is used to form the semifinished product hollow hole 20, the bottom surface 20*a* of the semifinished product hollow hole 20 can be formed in the inverted cone shape. This suppresses the reduction of the radius of the corner caused by the corner of the bottom surface 10*a* and the inner circumference surface 10*b* of the hollow hole 10 being folded, when the necking process is performed on the semifinished product valve stem portion 22, compared to the case where the bottom surface 20*a* of the semifinished product hollow hole 20 is flat. Accordingly, it is possible to reduce the stress concentration generated at this corner during the use of the hollow engine valve and manufacture the hollow engine valve 1 with high durability.

Specifically, since the angle of the tip end of the drill bit is from 140° to 178° inclusive, the bottom surface 20*a* of the semifinished product hollow hole 20 can be formed in the inverted cone shape with an apex angle of from 140° to 178° inclusive. This makes it possible to suppress the reduction of the radius of the corner between the bottom surface 10*a* and the inner circumference surface 10*b* of the hollow hole 10 when the necking process is performed on the semifinished product valve stem portion 22, while keeping the inner diameter of the bottom surface 10*a* of the hollow hole 10 an appropriate size. Accordingly, it is possible to manufacture the hollow engine valve 1 in which weight reduction and high cooling performance achieved by forming the hollow hole 10 with an appropriate size is made compatible with high durability achieved by the reduction of stress concentration at the corner of the bottom surface 10*a* and the inner circumference surface 10*b* of the hollow hole 10.

EXPLANATION OF THE REFERENCE NUMERALS

1 hollow engine valve
2 valve main body
6 valve head portion
8 valve stem portion
10 hollow hole
12 solid round bar
14 semifinished product valve head portion
16 solid stem portion
18 valve main body intermediate member
20 semifinished product hollow hole
22 semifinished product valve stem portion
24 valve main body semifinished product

The invention claimed is:

1. A manufacturing method for a hollow engine valve including a valve main body in which a hollow hole with a bottom is formed through both a valve head portion and a valve stem portion connected to the valve head portion, the manufacturing method comprising the steps of:

forming, only by forging, a solid round bar which is a material of the valve main body into a valve main body intermediate member having a semifinished product valve head portion which forms the valve head portion and a solid stem portion which forms the valve stem portion;

forming the valve main body intermediate member into a valve main body semifinished product having the semifinished product valve head portion and a semifinished product valve stem portion which forms the valve stem portion, by performing only a cutting process on the valve main body intermediate member through both the solid stem portion and the semifinished product valve head portion to form a semifinished product hollow hole with a bottom, the semifinished product hollow hole forming the hollow hole; and forming the valve main body semifinished product into the valve main body, by performing a necking process on the valve main body semifinished product by drawing the semifinished product valve stem portion in stages to reduce a diameter of the semifinished product valve stem portion and increase a shaft length of the semifinished product valve stem portion.

2. The manufacturing method for a hollow engine valve according to claim 1, wherein in the step of forming the semifinished product hollow hole to form the hollow hole, the semifinished product hollow hole is formed with a drill bit with an inclined tip end.

3. The manufacturing method for a hollow engine valve according to claim 2, wherein an angle of the tip end of the drill bit is from 140° to 178° inclusive.

* * * * *